US009306299B2

(12) United States Patent
Yoshida et al.

(10) Patent No.: US 9,306,299 B2
(45) Date of Patent: Apr. 5, 2016

(54) CONNECTION TERMINAL HAVING SUPERIMPOSED FLAT PLATE SHAPED ATTACHING PARTS

(71) Applicant: YAZAKI CORPORATION, Tokyo (JP)

(72) Inventors: Haruki Yoshida, Shizuoka (JP); Yoshitaka Tsushima, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/428,089

(22) PCT Filed: Oct. 18, 2013

(86) PCT No.: PCT/JP2013/078363
§ 371 (c)(1),
(2) Date: Mar. 13, 2015

(87) PCT Pub. No.: WO2014/061797
PCT Pub. Date: Apr. 24, 2014

(65) Prior Publication Data

US 2015/0270629 A1 Sep. 24, 2015

(30) Foreign Application Priority Data

Oct. 19, 2012 (JP) ..... 2012-231604

(51) Int. Cl.
*H01R 13/625* (2006.01)
*H01R 11/12* (2006.01)
*H01R 13/627* (2006.01)
(Continued)

(52) U.S. Cl.
CPC ..... *H01R 11/12* (2013.01); *H01R 13/627* (2013.01); *H01R 43/16* (2013.01); *H01R 11/09* (2013.01)

(58) Field of Classification Search
CPC ..... H01R 11/03; H01R 11/12; H01R 13/62; H01R 13/627; H01R 13/6271; H01R 13/639
USPC ..... 439/345, 351, 352, 355
See application file for complete search history.

(56) References Cited

U.S. PATENT DOCUMENTS 8,794,990 B2 * 8/2014 Deno ..... H01R 4/646 439/345
2013/0122731 A1 5/2013 Deno et al.
(Continued)

FOREIGN PATENT DOCUMENTS

JP 2004-327355 A 11/2004
JP 2011-134671 A 7/2011
JP 2012-29512 A 2/2012

OTHER PUBLICATIONS

International Search Report and Written Opinion of the International Search Report for PCT/JP2013/078363 dated Jan. 14, 2014.
(Continued)

*Primary Examiner* — Chandrika Prasad
(74) *Attorney, Agent, or Firm* — Kenealy Vaidya LLP

(57) ABSTRACT

The present invention provides a connection terminal (1) which includes terminal members (2, 3) having cylindrical wire connecting parts (21, 31) to which conductors of electric wires are inserted and the conductors are electrically connected, and flat plate shaped attaching parts (22, 32) continuous to the wire connecting parts.

3 Claims, 5 Drawing Sheets

(51) Int. Cl.
*H01R 43/16* (2006.01)
*H01R 11/09* (2006.01)

(56) References Cited

U.S. PATENT DOCUMENTS

2015/0229047 A1* 8/2015 Yoshida ..... H01R 11/09
439/889
2015/0303674 A1* 10/2015 Yoshida ..... H01R 4/26
174/74 R

OTHER PUBLICATIONS

International Preliminary Report on Patentability and English language Written Opinion of the International Search Report for PCT/JP2013/078363.

* cited by examiner (a)

(b)

(a)

(b)

(a)

(b)

CONNECTION TERMINAL HAVING SUPERIMPOSED FLAT PLATE SHAPED ATTACHING PARTS

TECHNICAL FIELD

The present invention relates to a connection terminal electrically connected to an electric wire and more specifically to a connection terminal in which two terminal members, which are regarded as one set, are used in a state where they are superposed one on another.

BACKGROUND ART

Various kinds of electric wires have connection terminals (also referred simply to as terminals, hereinafter) connected to end parts of the electric wires and are connected to a device of a connection mate side through the terminals. Various kinds of terminals are suitably used depending on the kinds of the electric wires to be connected. For instance, in various kinds of vehicles such as motor vehicles, as electric wires for wiring electrical equipments, coaxial electric wires are widely employed. As one example of the terminal connected to such a coaxial electric wire, a terminal is known in which two terminal members, which are regarded as one set, are used in a state where they are superposed one on another (see Patent Literature 1). Each of the terminal members (referred to as a terminal fitting, hereinafter) includes a cylindrical wire connecting part to which a conductor (a braided wire or the like) of the coaxial electric wire is connected and a flat plate shaped attaching part which attaches the wire connecting part to a member to which the wire connecting part is attached. The wire connecting part covers an outer periphery of the conductor (a terminal part) which is exposed by peeling an outer sheath (an insulating coating) of the electric wire so as to accommodate therein, then, is crimped to attach and connect the wire connecting part to the end part of the conductor. The attaching part has one outer edge connected to the wire connecting part and a bolt through hole provided in a flat part to which a bolt is inserted. Then, in the two terminal fittings, the attaching parts are superposed one upon another so that the mutual bolt through holes communicate with each other and the two terminal fittings are fastened and fixed to an attached member, for instance, a vehicle body panel forming a vehicle body of the motor vehicle, more specifically, a weld nut provided in the vehicle body panel by the bolt inserted into the bolt through holes. As such, an end process can be carried out, for instance, the conductor (the braided wire) of the coaxial electric wire connected to the wire connecting part is grounded through the attached member such as the vehicle body panel.

Here, when the terminal is attached to the attached member, the two terminal fittings may possibly relatively rotate to shift in their position. Namely, when the bolt is fastened to the weld nut, the terminal fitting of the two superposed terminal fittings which is located in a front side relative to a fastening direction may possibly rotate in the rotating direction of the bolt relative to the other terminal fitting.

Thus, Patent Literature 1 discloses a structure of a terminal in which an engaging part is provided in an attaching part of one of two terminal fittings and an engaged part with which the engaging part is engaged is provided in a fixing part of the other terminal fitting. In this terminal structure, since the engaging part is engaged with the engaged part, a relative positional shift of the two terminal fittings can be prevented.

CITATION LIST

Patent Literature

Patent Literature 1: JP-A-2012-29512

SUMMARY OF INVENTION

Technical Problem

However, the terminal disclosed in Patent Literature 1 does not have a structure which protects the engaging part in a state where the engaging part is engaged with the engaged part. Accordingly, when an external force is applied to the terminal, such an external force may be directly applied to the engaging part. There is a risk that the engaging part may be possibly resiliently deformed in a direction which releases an engagement with the engaged part depending on a degree of the external force applied to the terminal or a position to which the external force is applied. As a result, the engagement of the engaging part and the engaged part is insufficient, or the engagement is released so that the two terminal fittings may possibly relatively rotate, and a shift in position may occur in these terminal fittings.

Further, even when such an external force as described above is not applied to the terminal, for instance, if strength of the engaging part or the engaged part itself is insufficient, when a bolt is fastened to a weld nut or after a fastening operation of the bolt is finished, the engagement of the engaging part and the engaged part may be possibly released due to a weak holding force of the engaging part and the engaged part. As a result, as in case that the external force is applied to the terminal, the shift in position may possibly occur in the two terminal fittings.

The present invention is devised by considering the above-described circumstances and it is an object of the present invention to provide a connection terminal which can prevent a positional shift of two terminal members.

Solution to Problem

In order to solve the above problem, an aspect of the present invention provides a connection terminal including two terminal members which include hollow and tubular wire connecting parts to which conductors of electric wires are inserted and the conductors are electrically connected, and flat plate shaped attaching parts continuous to the wire connecting parts, wherein the two terminal members are configured such that the attaching parts are superposed one upon another in a state where an engaging part provided in the one terminal member is engaged with an engaged part provided in the other terminal member, the attaching part of the one terminal member has a bent part formed by bending a part of the attaching part relative to the other part of the attaching part, wherein the bent part has an opening formed as the engaging part, and the attaching part of the other terminal member has a protection wall part formed by bending a part of the attaching part relative to the other part of the attaching part in the same direction as that of the bent part so that the protection wall part is parallel to the bent part, wherein the protection wall part has a protruding piece formed as the engaged part and protruding toward the opening.

According to this configuration, in a state where the attaching part of the other terminal member is superposed upon the attaching part of the one terminal member so as to mount the attaching part of the other terminal member on the attaching part of the one terminal member so that the two terminal members are formed as one set, even when an external force (a force which is liable to resiliently deform the bent part toward a direction that releases the engagement of the engaging part with the engaged part) acts on the terminal members, such an external force initially acts on the protection wall part and can be prevented from directly acting on the bent part. As a result, the resilient deformation of the bent part by the external force is suppressed and the engagement of the engaging part with the engaged part can be sufficiently maintained.

Another aspect of the present invention provides a connection terminal in which the protection wall part has a tip end which is located above a tip end of the bent part. Accordingly, even when an external force (a force which is liable to resiliently deform the bent part toward a direction that releases the engagement of the engaging part with the engaged part) acts on the terminal members, such an external force initially acts on the protection wall part and can be prevented from directly acting on the bent part. Especially, since the bent part is protected even for its tip end part by the protection wall part, the external force can be prevented from being applied to the tip end part of the bent part which gives a large influence to the engagement of the engaging part and the engaged part.

Another aspect of the present invention provides a connection terminal in which the attaching part of the one terminal member includes two rotation-preventing parts which are continuous so as to intersect with the attaching part and the bent part, and the rotation-preventing parts are provided at positions where the protection wall part is disposed between the rotation-preventing parts when the attaching parts are superposed one upon another. Accordingly, the rotation-preventing parts function as reinforcing ribs which reinforce rigidity of the bent part. Thus, strength of the bent part (in other word, the engaging part) can be improved. Accordingly, when the attaching parts are attached to an attached member, or after the attaching parts are attached to the attached member, even if the engaging part interferes with the engaged part, the engaging part can be restrained from being resiliently deformed. Especially, in the state where the attaching part of the other terminal member is superposed on the attaching part of the one terminal member so as to be mounted thereon so that the two terminal members are formed as the one set, even when an external force (a force in a direction which relatively rotates the two terminal members) is applied to the terminal members, the engagement of the engaging part with the engaged part is maintained. Accordingly, the two terminal members can be assuredly prevented from being relatively rotated by the external force.

Advantageous Effects of Invention

According to the present invention, the connection terminal can be realized which can prevent a positional shift of the two terminal members.

DESCRIPTION OF EMBODIMENTS

Now, a connection terminal (referred simply to as a terminal, hereinafter) according to the present invention will be described below by referring to FIG. 1 to FIG. 5. An electric wire to which the terminal of the present invention is connected has a structure including, for instance, an inner conductor, a first insulating coating (referred to as an inner insulator, hereinafter) with which the inner conductor is coated, an outer conductor provided coaxially with the inner conductor to surround an outer periphery of the inner insulator and a second insulating coating (similarly referred to as an outer insulator) with which the outer conductor is coated. Further, the electric wire may have a structure further including a shield conductor provided coaxially with the inner conductor and the outer conductor to surround an outer periphery of the outer insulator and a third insulating coating (referred to as a protection sheath, hereinafter) with which the shield conductor is coated. In this case, the inner conductor, the outer conductor and the shield conductor may respectively have arbitrary forms. For instance, the inner conductor may be formed as a stranded wire, the outer conductor may be formed as a stranded wire or a braided wire and the shield conductor may be formed as a braided wire or a foil. Further, the inner insulator, the outer insulator and the protection sheath may be formed with an insulating material (for instance, a resin of polyethylene, vinyl chloride, silicon or the like). The above-described electric wire is used as an electric wire for wiring in a part (for instance, in an electrical equipment of a motor vehicle or the like) which needs to be shielded from an electromagnetic wave and formed as, what is called a coaxial electric wire. However, a use of the terminal according to the present invention is not limited to a terminal connected to the coaxial electric wire.

Figure 1:
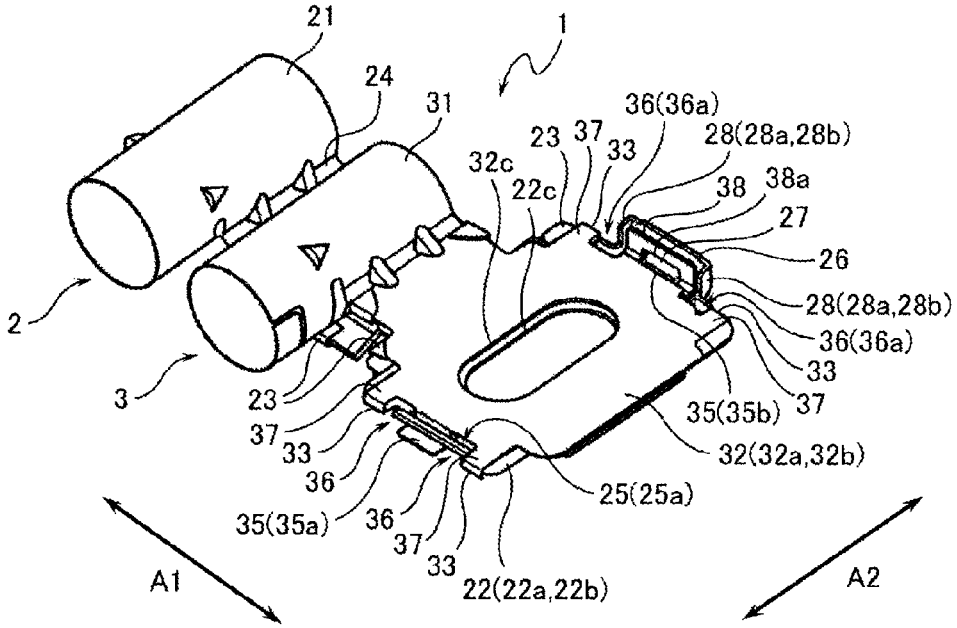
FIG. 1 is a perspective view showing an entire part of a connection terminal according to one embodiment of the present invention.
Figure 2:
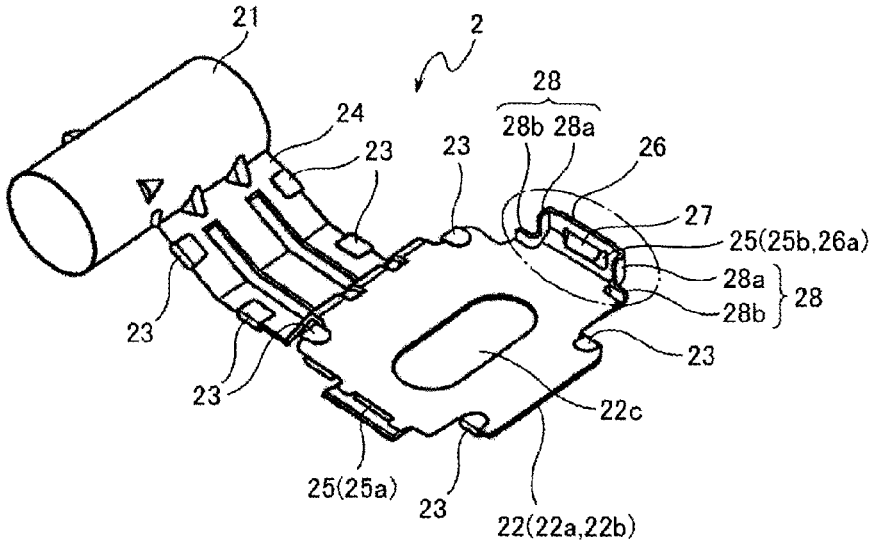
FIG. 2(*a*) and FIG. 2(*b*) are diagrams showing a structure of one of two terminal members (terminal fittings) forming the connection terminal, in which FIG. 2(*a*) is a perspective view showing an entire structure and FIG. 2(*b*) is an enlarged perspective view in a chain line circle shown in FIG. 2(*a*).
Figure 2:
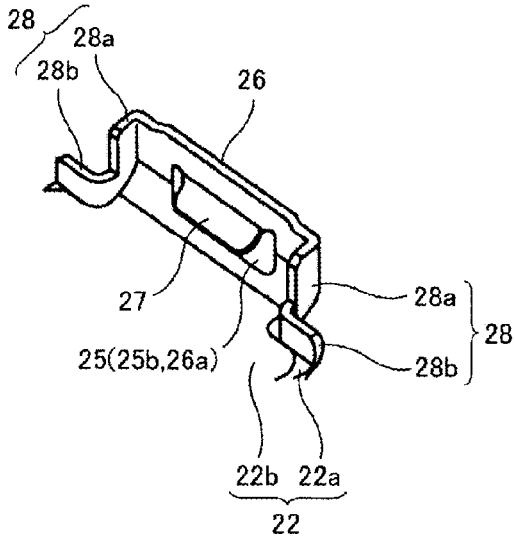
Figure 3:
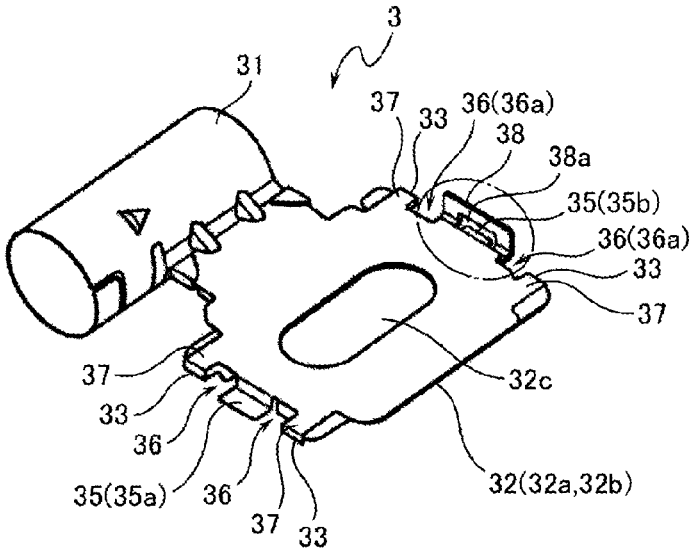
FIG. 3(*a*) and FIG. 3(*b*) are diagrams showing a structure of the other terminal member (terminal fitting), in which FIG. 3(*a*) is a perspective view showing an entire structure and FIG. 3(*b*) is an enlarged perspective view in a chain line circle shown in FIG. 3(*a*).
Figure 3:
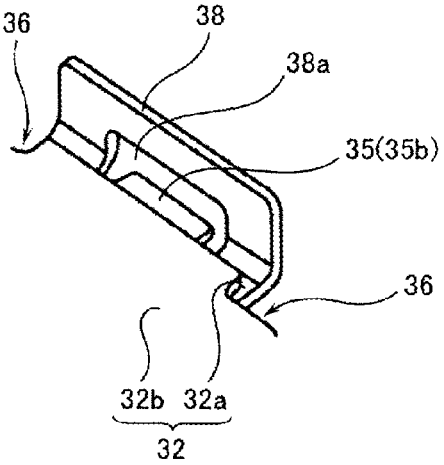

FIGS. 1 to 3(*b*) show a structure of the terminal according to one embodiment of the present invention. FIG. 1 is a perspective view showing an entire part of the terminal. FIG. 2(*a*) and FIG. 2(*b*) are diagrams showing a structure of one of two terminal members (referred to as terminal fittings, hereinafter) forming the terminal. FIG. 2(*a*) is a perspective view showing an entire structure and FIG. 2(*b*) is an enlarged perspective view in a chain line circle shown in FIG. 2(*a*). Further, FIG. 3(*a*) and FIG. 3(*b*) are diagrams showing a structure of the other terminal fitting. FIG. 3(*a*) is a perspective view showing an entire structure, and FIG. 3(*b*) is an enlarged perspective view in a chain line circle shown in FIG. 3(*a*).

As shown in FIG. 1 to FIG. 3(*b*), the terminal 1 according to the present embodiment is used in a state where the two terminal fittings 2 and 3 are superposed one upon another as one set. The terminal fittings 2 and 3 respectively include cylindrical wire connecting parts 21 and 31 to which the conductors (for instance, the stranded wires or the braided wires) of the electric wire (not shown in the drawing) are inserted and connected and flat plate shaped attaching parts 22 and 32 continuous to the wire connecting parts 21 and 31. The wire connecting parts 21 and 31 are attached to an attached member through the attaching parts 22 and 32. As long as the attached member is a member having a pedestal part which can hold the attaching parts 22 and 32 in stable attitudes, the attached member is not especially restricted. For instance, the attached member is a vehicle body panel forming a vehicle body of the motor vehicle, more specifically, a weld nut provided in the vehicle body panel. In this case, the two terminal fittings 2 and 3 are attached to the attached member under a state the terminal fittings 2 and 3 are superposed one upon another so as to mount a part of the other terminal fitting (corresponding to a below-described attaching part 32 of the terminal fitting 3 in FIG. 1) on a part of the one terminal fitting (corresponding to a below-described attaching part 22 of the terminal fitting 2 in FIG. 1). At that time, an inclusively fastening member is further mounted on the two terminal fittings 2 and 3 (specifically, the attaching part 32). In a state where these members are superposed, the terminal 1 is attached to the attached member.

The terminal fittings 2 and 3 shown in FIG. 1 to FIG. 3(*b*) are formed by applying a blanking or stamping work or a bending work to a metallic sheet having an electric conductivity. Specifically, the sheet is blanked or stamped so as to have an entire form obtained by expanding the terminal fittings 2 and 3. Then, a part of the blanked or stamped sheet is bent so as to have a cylindrical form, so that the wire connecting parts 21 and 31 are formed. On the other hand, another part of the blanked or stamped sheet is folded and bent to have a flat plate shape, so that the attaching parts 22 and 32 are formed. Thus, the attaching parts 22 and 32 are formed in such a way that the flat plate shaped sheet is superposed so as to be continuous to the wire connecting parts 21 and 31. In a below-described explanation, parts located in a lower side (the terminal fitting 2 side in the terminal 1) of the superposed sheets which form the attaching parts 22 and 32 are referred to as attaching parts 22*a* and 32*a*. Parts located in an upper side (the terminal fitting 3 side in the terminal 1) are referred to as attaching parts 22*b* and 32*b*. Further, in a below-described explanation, a direction (a direction shown by an arrow mark A1 in FIG. 1) that the wire connecting parts 21 and 31 are continuous to the attaching parts 22 and 32 is called a longitudinal direction. A direction (a direction shown by an arrow mark A2 in FIG. 1) which intersects at right angles to the continuous direction (the longitudinal direction) on a plane formed by attaching parts 22 and 32 is called a transverse direction. However, the vertical direction, the longitudinal direction and the transverse direction do not necessarily need to correspond to directions (for instance, a vertical direction, a longitudinal direction or a transverse direction of the motor vehicle) respectively in a state that the terminal 1 is actually used.

The wire connecting parts 21 and 31 cover the conductors exposed by peeling the insulating coatings of the electric wires, for instance, terminal parts of the outer conductors exposed by peeling the outer insulators so as to accommodate therein, and are crimped so as to reduce diameters in this state. Thus, the wire connecting parts 21 and 31 are attached under pressure to the terminal parts of the outer conductors and electrically connected thereto. In the electric connecting parts 21 and 31, inside diameters of the cylindrical parts before the wire connecting parts are crimped are set to be larger than outside diameters of the terminal parts of the outer conductors. Thus, the wire connecting parts 21 and 31 are inserted to outer peripheries of the terminal parts of the outer conductors so that the terminal parts of the outer conductors may be covered with the electric connecting parts 21 and 31. Further, the wire connecting parts 21 and 31 which accommodate the terminal parts of the outer conductors therein are crimped, so that the wire connecting parts 21 and 31 are attached under pressure to the terminal parts of the outer conductors and the outer conductors can be electrically connected to the wire connecting parts 21 and 31. Since the wire connecting parts 21 and 31 may be formed in the cylindrical shapes corresponding to the outside diameters of the conductors of the electric wires (the terminal parts of the outer conductors, as one example), they may be formed in the cylindrical shapes having the same inside diameters or formed in the cylindrical shapes having different inside diameters.

In the attaching parts 22 and 32, are extended a plurality of fixing pieces 23 and 33 from one outer edges of the attaching parts 22*a* and 32*a* or the attaching parts 22*b* and 32*b*. These fixing pieces 23 and 33 are folded back toward the other outer edges of the attaching parts 22*a* and 32*a* or the attaching parts 22*b* and 32*b*, so that the attaching parts 22*a* and 32*a* and the attaching parts 22*b* and 32*b* are integrally fixed. In such a way, the superposed part (the attaching parts 22*a* and 32*a* and the attaching parts 22*b* and 32*b*) of the sheet is prevented from opening.

Further, in the attaching parts 22 and 32, hole parts 22*c* and 32*c* are formed which pass through parts near central parts thereof in the direction of thickness. As one example, the hole parts 22*c* and 32*c* are formed in the configurations of slots. Thus, as described below, when the terminal fittings 2 and 3 are attached to the attached member (as one example, the weld nut provided in the vehicle body panel), even if an error (a shift in an arranged position of the weld nut) occurs in the pedestal part of the attached member, such an error can be absorbed by the slot shaped hole parts 22*c* and 32*c*. Accordingly, an attaching operation which attaches the terminal fittings 2 and 3 to the attached member can be rapidly carried out.

In the present embodiment, the one terminal fitting 2 has a structure, as shown in FIG. 2(*a*), that the other end edge of the wire connecting part 21 in the transverse direction is continuous to one end edge of the attaching part 22 in the transverse direction through a below-described holding part 24. Further, the other terminal fitting 3 has a structure, as shown in FIG. 3(*a*), that the other end edge of the wire connecting part 31 in the transverse direction is continuous to one end edge of the attaching part 32 in the transverse direction. Relative positions of the wire connecting parts 21 and 31 and the attaching parts 22 and 32 in the transverse direction in the terminal fittings 2 and 3 are not limited to the structures shown in FIGS. 1 to 3(*b*) and may be arbitrarily set. For instance, conversely to the structures shown in FIGS. 2(*a*) to 3(*b*), the one end edges of the wire connecting parts 21 and 31 in the transverse direction may be continuous to the other end edges of the attaching parts 22 and 32 of the terminal fittings 2 and 3 in the transverse direction.

Further, the one terminal fitting 2 has the holding part 24 extending between the wire connecting part 21 and the attaching part 22. The holding part 24 is formed as an arm on which the wire connecting part 31 of the terminal fitting 3 is mounted in a state where the attaching parts are superposed one upon another so as to mount the attaching part 32 of the other terminal fitting 3 on the attaching part 22, namely, the two terminal fittings 2 and 3 are formed as one set. The holding part 24 is connected respectively to the wire connecting part 21 and the attaching part 22. When the sheet is folded to form the flat plate shaped attaching part 22, the sheet is superposed to have a flat plate shape at the same time. The holding part 24 is formed in such a way that a recessed part along a circumferential surface of the wire connecting part 31 is formed along a longitudinal direction of the wire connecting part 21 so that the wire connecting part 31 mounted thereon is arranged substantially in parallel with the wire connecting part 21 of the terminal fitting 2. The recessed part is located in an intermediate part in the longitudinal direction and formed by bending the holding part 24 along the longitudinal direction of the wire connecting part 21. In a below-described explanation, the sheet of the two superposed upper and lower sheets forming the holding part 24 which is located in a lower side (in an opposite side to a side on which the attaching part 32 (the terminal fitting 3) is mounted) is referred to as a lower side holding part, and the sheet located in an upper side (the side on which the attaching part 32 (the terminal fitting 3) is mounted) is referred to as an upper side holding part. Further, in the holding part 24, a plurality of fixing pieces 23 are extended from one outer edges of the lower side holding part or the upper side holding part as in the attaching part 22. These fixing pieces 23 are folded back toward the other outer edges of the lower side holding part or the upper side holding part. Thus, the lower side holding part and the upper side holding part are integrally fixed. In such a way, the superposed part of the sheet (namely, the lower side holding part and the upper side holding part) is prevented from opening.

In the terminal fittings 2 and 3, the fixing pieces 23 and 33 are extended from edges of one of the superposed sheets which form the fixing attaching parts 22 and 32 and the holding part 24 and bent so as to be superposed on the other sheet, so that the sheets are fixed to each other. In this case, the fixing pieces 23 and 33 are crimped so as to grip the edges of the attaching parts 22 and 32 and the holding part 24 to fix respectively the sheets, namely, the attaching parts 22*a* and 22*b*, the attaching parts 32*a* and 32*b* and the lower side holding part and the upper side holding part to each other.

In the structure shown in FIG. 2(*a*), the fixing pieces 23 of the terminal fitting 2 are respectively extended from the edges in the longitudinal direction and the transverse direction of the sheet located in the lower side of the superposed sheet forming the attaching part 22 and the holding part 24, namely, the attaching part 22*a* located in the opposite side to a side on which the attaching part 32 (the terminal fitting 3) is mounted and the edges of the lower side holding part in the transverse direction and bent and crimped so as to be superposed on the upper side (the side on which the attaching part 32 is mounted) attaching part 22*b* and the upper side holding part. In such a way, the attaching parts 22*a* and 22*b* are fixed to each other. The lower side holding part and the upper side holding part are fixed to each other.

Further, in the structure shown in FIG. 3(*b*), the fixing pieces 33 of the terminal fitting 3 are extended from the edges in the transverse direction of the sheet located in the upper side of the superposed sheet forming the attaching part 32, namely, the attaching part 32*b* located in the opposite side to a side to be mounted on the attaching part 22 (the terminal fitting 2) and bent and crimped so as to be superposed on the lower side attaching part 32*a* (in the side to be mounted on the attaching part 22)). In such a way, the attaching parts 32*a* and 32*b* are fixed to each other.

As described above, the superposed attaching parts 22*a* and 22*b*, and the lower side holding part and the upper side holding part are fixed together by the fixing pieces 23. Further, the attaching parts 32*a* and 32*b* are fixed to each other by the fixing pieces 33. Thus, the superposed sheets which form the attaching parts 22, 32 and the holding part 24 can be prevented from opening. As a result, the forms of the attaching parts 22 and 32 and the holding part 24 can be stabilized and durability and strength can be improved. Further, the attaching parts 22 and 32 and the holding part 24 in a state of a single item before the two terminal fittings 2 and 3 are attached to the attached member are prevented from opening. Accordingly, serviceability can be improved during an attaching operation of the terminal fittings 2 and 3 to the attached member.

In the two terminal fittings 2 and 3, the attaching parts 22 and 33 are superposed one upon another so that the hole parts 22*c* and 32*c* communicate with each other and the terminal fittings 2 and 3 are attached to the attached member by an attaching member which is allowed to pass through the communicating hole parts 22*c* and 32*c*. In the present embodiment, one example of the attaching member is a bolt. The attaching parts 22 and 33 are fastened and fixed to the weld nut provided in the vehicle body panel by the bolt. At that time, the inclusively fastening member is mounted on the two terminal fittings 2 and 3 (specifically, the attaching part 32) and fastened together with the attaching parts 22 and 33 by the bolt. Thus, a terminal process can be carried out, for instance, the outer conductors connected to the wire connecting parts 21 and 31 are grounded through the vehicle body panel.

The two terminal fittings 2 and 3 are superposed one upon another in a state where an engaging part 25 provided in the one terminal fitting 2 is engaged with an engaged part 35 provided in the other terminal fitting 3. In the terminal fitting 2, two engaging parts 25*a* and 25*b* are provided. In the terminal fitting 3, two engaged parts 35*a* and 35*b* are provided which can be respectively engaged with the engaging parts 25*a* and 25*b*. Specifically, the engaging part 25*a* and the engaged part 35*a* are provided so as to be engaged with each other. The engaging part 25*b* and the engaged part 35*b* are provided so as to be engaged with each other.

The one engaging part 25*a* of the terminal fitting 2 is extended from the lower side (the opposite side to the side on which the attaching part 32 is mounted) attaching part 22*a* of the superposed sheet (the attaching parts 22*a*, 22*b*) which forms the attaching part 22. The attaching part 22*a* is extended in parallel with the attaching part 22*a* from one end edge in the transverse direction of the attaching part 22*a*, and a tip end part thereof is bent upward. In the bent part of the attaching part 22*a*, an opening (a through hole bored so as to pass through that part) is formed which the below-described engaged part 35*a* is inserted to and engaged with. The opening functions as the engaging part 25*a*. A degree of bending of the bent part of the attaching part 22*a* may be set in such a way that a height (a bending height) of the tip end of the bent part from the flat plate shaped attaching part 22*a* is substantially the same as or a little lower than the attaching part 32 (specifically, an upper surface of the upper side attaching part 32*b*) mounted on the attaching part 22 in the state where the engaging part 25*a* is engaged with the engaged part 35*a*. Thus, when the engaging part 25*a* is engaged with a below-described bent part (a stepped part) of the engaged part 35*a*, the bent part of the engaging part 25*a* does not protrude more than the attaching part 32 (more specifically, the attaching part 32*b*) and the attaching part 32*b* can be maintained to be in a flat state. Accordingly, for instance, even when the inclusively fastening member is mounted on the terminal fittings 2 and 3 (specifically, the attaching part 32) and fastened together with the attaching parts 22 and 32 by the bolt, the inclusively fastening member does not interfere with the bent part of the engaging part 25*a* and an attitude thereof can be stabilized.

The one engaged part 35*a* of the terminal fitting 3 is provided in the upper side (the opposite side to the side to be mounted on the attaching part 22) attaching part 32*b* of the superposed sheet which forms the attaching part 32. The attaching part 32*b* is extended and bent downward from one edge in the transverse direction of the attaching part 32*b*, and then, a tip end part thereof is extended in parallel with the attaching part 32*b*. In the bent part (the stepped part) of the attaching part 32*b*, two cut-out parts 36 are formed which are cut out along the transverse direction. Namely, a part of the bent part which is disposed between the two cut-out parts 36 is the engaged part 35*a*. The engaged part 35*a* is disposed between the two cut-out parts 36 and also disposed between parts (protruding parts) 37 which are formed outside the cut-out parts 36 by forming the cut-out parts 36 and protrude in parallel with the attaching part 32*b*. In this case, since the attaching part 32*b* is bent downward, the engaged part 35*a* has a structure including a stepped part the more for the protruding parts 37. The bent part (the stepped part) is engaged with the engaging part 25*a*.

Thus, while the engaged part 35*a* is inserted to the engaging part 25*a*, the terminal fitting 3 is superposed on the terminal fitting 2 so as to mount the attaching part 32 on the attaching part 22, so that the engaged part 35*a* can be engaged with the engaging part 25*a*. Specifically, the bent part (the stepped part) of the engaged part 35*a* interferes with a peripheral edge of the opening of the engaging part 25*a* and is engaged therewith. When the engaged part 35*a* is allowed to be engaged with the engaging part 25*a*, for instance, the terminal fitting 3 is inclined relative to the terminal fitting 2 so that the tip end of the engaged part 35*a* may be inserted into the engaging part 25*a*. Then, the engaged part 35*a* is pushed in to the engaging part 25*a* until the bent part (the stepped part) abuts on the peripheral edge of the opening of the engaging part 25*a*. Then, the terminal fitting 3 may be superposed on the terminal fitting 2 in such a way that the terminal fitting 3 is rotated so as to be parallel to the terminal fitting 2 by using the bent part (the stepped part) of the engaged part 35*a* as a supporting point and to mount the attaching part 32 on the attaching part 22. In the engaging part 25*a* and the engaged part 35*a*, an opening width or length (dimensions relative to the longitudinal direction and the transverse direction) of the engaging part 25*a* and a protruding width or length (dimensions relative to the same directions as described above) of the engaged part 35*a* may be set so that the engaging part 25*a* may be engaged with the engaged part 35*a* with sufficient engagement margins.

Figure 4:
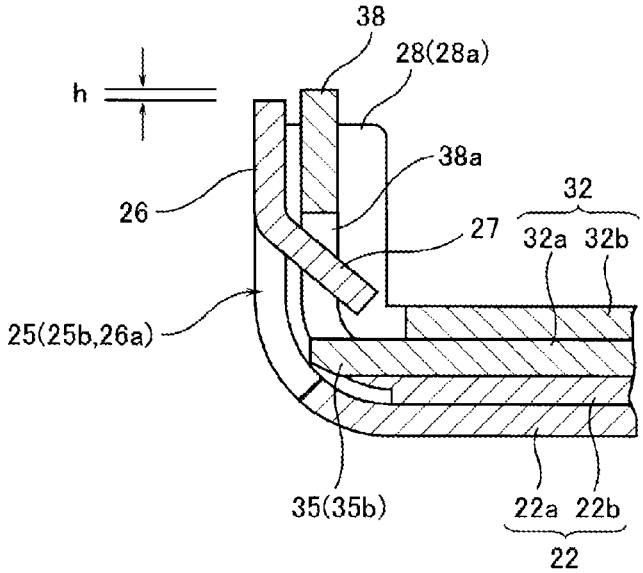
FIG. 4(*a*) and FIG. 4(*b*) show diagrams showing engaging states of an engaging part (an opening of a bent part) with an engaged part, in which FIG. 4(*a*) is a sectional view showing a proper engaging state of the engaging part (the opening of the bent part) with the engaged part, and FIG. 4(*b*) is a sectional view showing the engaging state of the engaging part and the engaged part when an external force which is liable to resiliently deform the bent part to a direction that releases an engagement of the engaging part and the engaged part.
Figure 4:
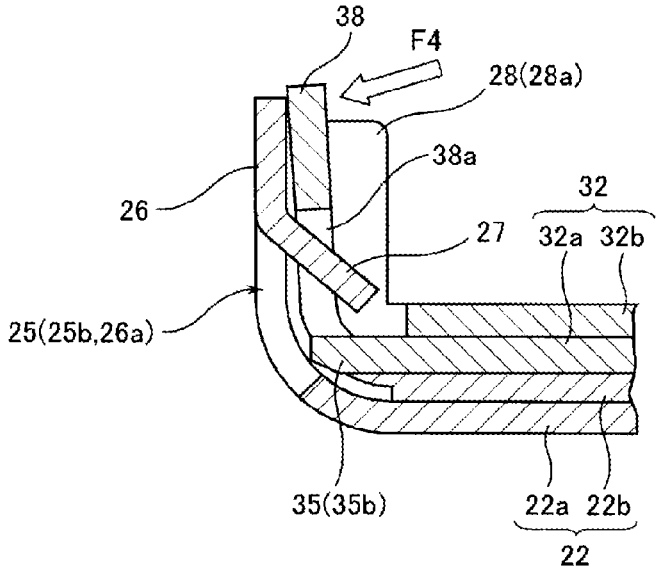

Further, in the present embodiment, the attaching part 22 of the one terminal fitting 2 has a bent part 26 formed by bending a part of the attaching part 22 relative to the other part. The bent part 26 is formed in the attaching part 22 by, for instance, a drawing work. The bent part 26 is provided in an end edge in an opposite side to the engaging part 25*a* with respect to the transverse direction of the attaching part 22. In the bent part 26, an opening 26*a* is formed as the other engaging part 25*b*. The bent part 26 has a structure that the other engaged part 35*b* provided in the attaching part 32 can be engaged with the opening 26*a*. FIG. 4(*a*) and FIG. 4(*b*) respectively show engaging states of the engaging part 25*b* (the opening 26*a* of the bent part 26) with the engaged part 35*b*. FIG. 4(*a*) is a sectional view showing a proper engaging state of the engaging part 25*b* (the opening 26*a* of the bent part 26) with the engaged part 35*b*. FIG. 4(*b*) is a sectional view showing the engaging state of the engaging part 25*b* and the engaged part 35*b* when an external force which is liable to resiliently deform the bent part 26 to a direction that releases a below-described engagement of the engaging part 25*b* and the engaged part 35*b*.

Specifically explained, as shown in FIG. 4(*a*), the bent part 26 is extended from the lower side (the opposite side to the side on which the terminal fitting 3 is mounted) attaching part 22*a* of the superposed sheet (the attaching parts 22*a* and 22*b*) which forms the attaching part 22. The bent part 26 is bent obliquely upward from the other end edge in the transverse direction of the attaching part 22*a*, and then, further bent so as to be substantially vertically elongated relative to the attaching part 22*a*. In the bent part 26, the opening (the through hole) 26*a* is formed which is bored in a part where a bending direction changes from the obliquely upward direction to the substantially vertical direction so as to pass through that part. The opening 26*a* functions as the engaging part 25*b*. Further, in the bent part 26, an engaging piece 27 which is inclined inside and extended downward from an upper end peripheral edge of the opening 26*a* is provided so as to close a part of the opening 26*a*. The engaging piece 27 is a blanked piece which is blanked or stamped when the opening 26*a* (the engaging part 25*b*) is formed, and is formed in such a way that the blanked piece is bent inward in a state where the blanked piece is connected to the upper end peripheral edge of the opening 26*a*.

Further, the attaching part 32 of the other terminal fitting 3 has a protection wall part 38 formed in such a way that a part of the attaching part 32 is bent in the same direction as that of the bent part 26 so as to be parallel to the bent part 26 relative to the other part. In the protection wall part 38, a protruding piece which protrudes toward the engaging part 25*b* (the opening 26*a* of the bent part 26) to be engaged with the engaging part 25*b* is provided as the engaged part 35*b*. As shown in FIG. 3(*a*) and FIG. 4(*a*), the protection wall part 38 is formed in such a way that the lower side (the side to be mounted on the attaching part 22) attaching part 32*a* of the superposed sheet which forms the attaching part 32 is protruded in parallel with the attaching part 32*a* from the other edge in the transverse direction of the attaching part 32*a*, and then, bent upward. As shown in FIG. 4(*a*), the protection wall part 38 is formed in such a way that when the terminal fitting 2 and the terminal fitting 3 are superposed one upon another and the engaged part 35*b* is engaged with the engaging part 25*b* so that the attaching part 32 is mounted on the attaching part 22 (in this case, the engaged part 35*a* is also engaged with the engaging part 25*a* at the same time), a tip end of the protection wall part 38 is located to protrude upward more than the tip end of the bent part 26. Since protrusion height of the protection wall part 38 to the tip end of the bent part 26 (a difference h shown in FIG. 4(*a*)) can be arbitrarily set depending on, for instance, a quality of material (a strength) or thickness of the terminal fittings 2 and 3, the protrusion height of the protection wall part is not especially specified herein. When the engaged part 35*b* is engaged with the engaging part 25*b*, the protection wall part 38 is located inside the bent part 26 (rightward in FIG. 4(*a*)), in a different point of view, located in a front side relative to a direction that the engaged part 35*b* is disengaged from the engaging part 25*b*. Since the protection wall part 38 is located as described above, an external force (a force shown by an arrow mark F4 in FIG. 4(*b*)) to a direction (leftward in FIG. 4(*a*)) that releases the engagement of the engaged part 35*b* and the engaging part 25*b* is applied to the protection wall part 38 before the external force is applied to the bent part 26. As a result, since the engagement of the engaged part 35*b* and the engaging part 25*b* is maintained, the engagement of the engaged part 35*b* and the engaging part 25*b* can be prevented from being released by the external force.

The protruding piece as the engaged part 35*b* is provided in the upper side (the opposite side to the side to be mounted on the attaching part 22) attaching part 32*b* of the superposed sheet which forms the attaching part 32 correspondingly to a position of the engaging part 25*b*. The protruding piece is formed to protrude from the other edge in the transverse direction of the attaching part 32*b* in parallel with the attaching part 32*b*. In this case, in both sides of the engaged part 35*b*, cut-out parts 36 are formed which are cut out along the transverse direction like the structure of the engaged part 35*a*. Namely, the engaged part 35*b* is disposed between the two cut-out parts 36. The engaged part 35*b* is formed so as to be disposed between the two cut-out parts 36. Further, the engaged part 35*b* is disposed between the two cut-out parts 36 and also disposed between parts (protruding parts) 37 which are formed outside the cut-out parts 36 by forming the cut-out parts 36 and protrude in parallel with the attaching part 32*b*.

Further, the protection wall part 38 has an opening (a through hole) 38*a* bored in the bent part so as to pass through that part. The protection wall part 38 has a structure that the protruding piece as the engaged part 35*b* is allowed to pass through the opening 38*a* and reach outward (leftward in FIG. 4(*a*)). In other words, the protection wall part 38 has a structure that the engaged part 35*b* is extended outward from the opening 38*a* so that the engaged part 35*b* may protrude toward the engaging part 25*b* (the opening of the bent part 26) so as to be engaged with the engaging part 25*b*.

Thus, when the terminal fitting 2 and the terminal fitting 3 are superposed one upon another so that the attaching part 32 is mounted on the attaching part 22 by inserting the engaged part 35*b* into the engaging part 25*b* (the opening 26*a* of the bent part 26*b*), the engaged part 35*b* can be engaged with the engaging part 25*b*. When the engaged part 35*b* is engaged with the engaging part 25*b*, for instance, the terminal fitting 3 is rotated so as to be parallel to the terminal fitting 2 with the above-described bent part (the stepped part) of the engaged part 35*a* used as the supporting point to insert the engaged part 35*b* into the engaging part 25*b*. At the same time, the engaging piece 27 of the bent part 26 is inserted into the opening 38*a* of the protection wall part 38. Then, the terminal fitting 3 is further rotated so that the terminal fitting 3 may be superposed on the terminal fitting 2 so as to mount the attaching part 32 on the attaching part 22. In this case, the engaging piece 27 is located in a state where the engaged part 35*b* is covered with the engaging piece 27, so that the engaging piece 27 can interfere with the engaged part 35*a*. In other words, the engaged part 35*a* is locked by the engaging piece 27. Further, in the state where the engaged part 35*b* is engaged with the engaging part 25*b*, as described above, the engaged part 35*a* is also engaged with the engaging part 25*a*. In the engaging part 25*b* (the opening 26*a* of the bent part 26) and the engaged part 35*b*, an opening width or length (dimensions relative to the longitudinal direction and the transverse direction) of the opening 26*a* as the engaging part 25*b*, a protruding width or length (dimensions relative to the same directions) of the protruding piece as the engaged part 35*b* and an extending width or length (dimensions relative to the same directions) of the engaging piece 27 may be set so that the engaging part 25*b* (the opening 26*a* of the bent part 26) and the engaged part 35*b* may be engaged with each other with sufficient engagement margins.

In the present embodiment, since the protection wall part 38 is formed so as to correspond to the bent part 26, in the state where the attaching part 32 is superposed upon the attaching part 22 so as to mount the attaching part 32 on the attaching part 22 so that the two terminal fittings 2 and 3 are formed as the one set, the protection wall part 38 can protect the bent part 26 from the external force. Namely, for instance, when the external force acts on the terminal fitting 2 and 3, specifically, even when a force (as one example, a force shown by an arrow mark F4 in FIG. 4(*b*)) which is liable to resiliently deform the bent part 26 toward a direction (leftward in FIG. 4(*b*)) that releases the engagement of the engaging part 25*b* with the engaged part 35*b*, such an external force F4 initially acts on the protection wall part 38 and does not directly act on the bent part 26. In such a way, such an external force F4 acts on the protection wall part 38, so that the external force can be prevented from being applied in a concentrated manner to the bent part 26 (especially, the tip end part) which gives a large influence to the engagement of the engaging part and the engaged part. Specifically, since the protection wall part 38 to which the external force F4 is applied is resiliently deformed outward (leftward in FIG. 4(*b*)), the external force F4 applied to the bent part 26 is exceptionally reduced. Accordingly, the bent part 26 can be restrained from being resiliently deformed outward, namely, toward a direction (leftward in FIG. 4(*b*)) that releases the engagement of the engaging part 25*b* and the engaged part 35*b*. Thus, the engagement of the engaging part 25*b* (the opening 26*a* of the bent part 26) and the engaged part 35*b*, in another point of view, the engagement of the engaging piece 27 and the engaged part 35*b* is not broken and a sufficient engaged state can be ensured. Accordingly, the engaged state of the engaging part 25*b* and the engaged part 35*b* can be continuously maintained.

Further, in the present embodiment, the bent part 26 has a pair of rotation-preventing parts 28 which are allowed to stand upright from the attaching part 22 of the one terminal fitting 2 so as to be able to interfere with both end edges of the parallel protection wall part 38. In other words, the attaching part 22 of the terminal fitting 2 has two rotation-preventing parts 28 which are continuous so as to intersect respectively the attaching part 22 and the bent part 26. The rotation-preventing parts 28 include holding part 28*a* which are respectively extended from both ends in the longitudinal direction of the bent part 26 toward the attaching part 22 along the transverse direction and abutting parts 28*b* which are further extended from the holding parts 28*a* along the longitudinal direction so as to be distant from each other. The holding part 28*a* formed in such a way as described above is provided so as to intersect the attaching part 22 and the bent part 26 respectively. Further, the abutting part 28*b* is provided so as to stand upright from the attaching part 22 and so as to be parallel to the bent part 26. These holding parts 28*a* and the abutting parts 28*b* are formed integrally with the bent part 26 at the same time when the bent part 26 is formed by a drawing work. In this case, the holding parts 28*a* are provided to stand upright from the attaching part 22 with substantially the same height as that of the bent part 26. The two holding parts 28*a* are provided at positions where the protection wall part 38 is disposed between the holding parts 28*a* when the attaching parts 22 and 32 are superposed one upon another. An opposed space (a space relative to the longitudinal direction) of the two holding parts 28*a* is set to be a little larger than a width (a dimension relative to the longitudinal direction) of the protection wall part 38. Thus, the holding parts 28*a* are formed in such a way that the holding parts 28*a* hold the protection wall part 38 from both sides in the longitudinal direction in the state where the attaching part 32 is superposed on the attaching part 22 so as to be mounted thereon to form the two terminal fittings 2 and 3 as one set. Further, the abutting parts 28*b* are lower than the bent part 26 and the holding parts 28*a* and allowed to stand upright with a height protruding from an upper surface of the attaching part 32 mounted on the attaching part 22. A length (a dimension relative to the longitudinal direction) of the abutting part 28*b* is set to be a little smaller than a width (a dimension relative to the same direction as described above) of the cut-out part 36 of the attaching part 32 (specifically, the cut-out part 36*a* shown in FIG. 1, FIG. 3 and FIG. 5). Thus, the abutting parts 28*b* are formed in such a way that the abutting parts 28*b* enter the cut-out parts 36*a* to abut on the cut-out parts 36*a* in the state where the attaching part 32 is superposed on the attaching part 22 so as to be mounted on the attaching part 22 so that the two terminal fittings 2 and 3 are formed as the one set.

Figure 5:
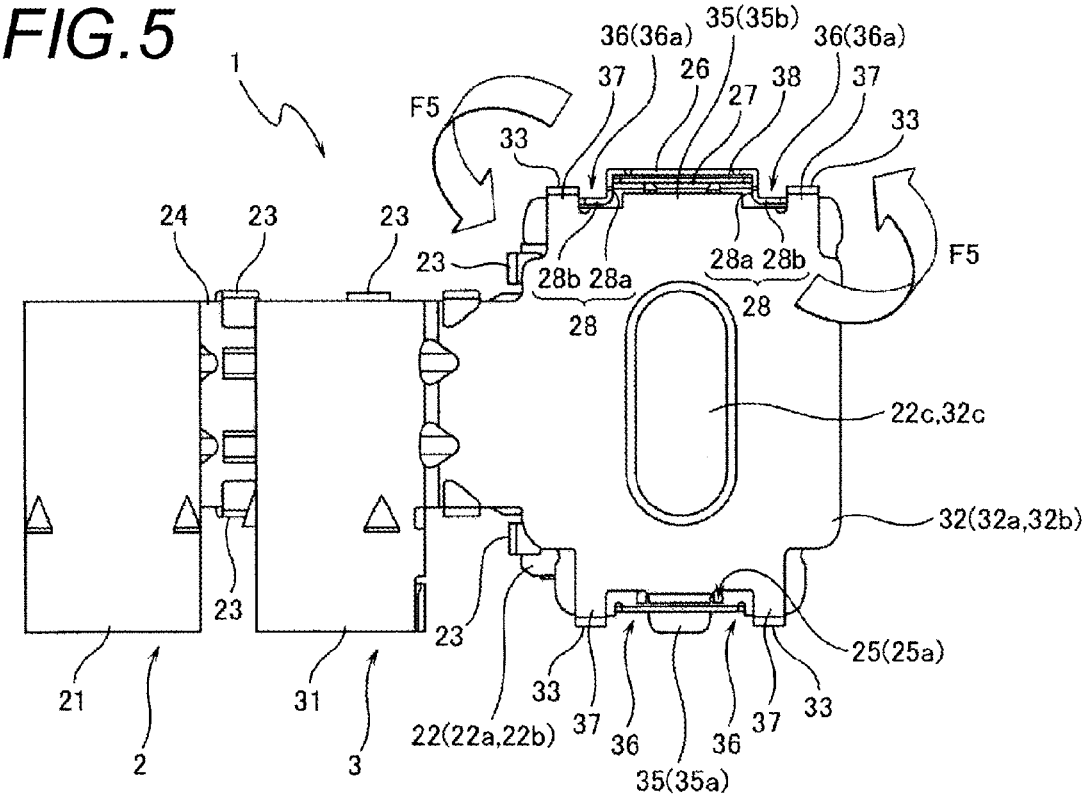
FIG. 5 is a plan view of the connection terminal when a force acts in a direction which relatively rotates the two terminal members (terminal fittings).

Since such rotation-preventing parts 28 (the holding parts 28*a* and the abutting parts 28*b*) are provided in the attaching part 22, the rotation-preventing parts 28 function as reinforcing ribs which reinforce rigidity of the bent part 26. Thus, the bent part 26, in other word, strength of the engaging part 25*b* can be improved. Accordingly, when the attaching parts 22 and 32 are attached to the attached member by the attaching member (for instance, the bolt) which is allowed to pass through the communicating hole parts 22*c* and 32*c* (as one example, fastened to the weld nut of the vehicle body panel by the bolt) or after the attaching parts 22 and 32 are attached (after fastened), even when the engaging part 25*b* interferes with the engaged part 35*b*, the engaging part 25*b* can be restrained from being resiliently deformed so as to collapse toward a direction that releases the engagement with the engaged part 35*b*. Especially, in the state where the attaching member 32 is superposed on the attaching part 22 so as to be mounted thereon to form the two terminal fittings 2 and 3 as the one set, the protection wall part 38 can be held from both the sides in the longitudinal direction by the holding parts 28*a* and the abutting parts 28*b* enter the cut-out parts 36*a* of the attaching part 32 to abut on the cut-out parts 36*a*. Thus, for instance, even when the external force is applied to the terminal fittings 2 and 3, specifically, when such a force (as one example, a force shown by an arrow mark F5 in FIG. 5) as to relatively rotate the terminal fittings 2 and 3 is applied to the terminal fittings 2 and 3, such an external force F5 can be distributed and loaded to the holding parts 28*a* and the abutting parts 28*b*, and the protection wall part 38 and the cut-out parts 36*a*. Accordingly, the two terminal fittings 2 and 3 can be assuredly prevented from being relatively rotated by the external force F5. FIG. 5 is a plan view of the terminal 1 when a force in a direction is applied which relatively rotates the two terminal fittings 2 and 3.

In the terminal 1 (the terminal fittings 2 and 3) according to the present embodiment, since the bent part 26 and the protection wall part 38 are provided, the engagement of the engaging part 25*b* and the engaged part 35*b* can be prevented from being insufficient or released. In addition thereto, since the attaching part 22 includes the rotation-preventing parts 28 (the holding parts 28*a* and the abutting parts 28*b*), the relative rotation of the two terminal fittings 2 and 3 can be prevented. Thus, a positional shift preventing effect of the two terminal fittings 2 and 3 can be improved. Thus, the terminal fittings 2 and 3 can be continuously kept in their proper positions.

Now, features of the above-described embodiment of the connection terminal according to the present invention will be respectively briefly summarized and listed in the following configurations [1] and [3].

[1] A connection terminal (1) including two terminal members (2, 3) which have hollow and tubular wire connecting parts (21, 31) to which conductors of electric wires are inserted and the conductors are electrically connected, and flat plate shaped attaching parts (22, 32) continuous to the wire connecting parts, wherein the two terminal members are configured such that the attaching parts are superposed one upon another in a state where an engaging part (25) provided in the one terminal member (2) is engaged with an engaged part (35) provided in the other terminal member (3), the attaching part (22) of the one terminal member has a bent part (26) formed by bending a part of the attaching part relative to the other part of the attaching part, wherein the bent part has an opening (25*b*) formed as the engaging part, and the attaching part (32) of the other terminal member has a protection wall part (38) formed by bending a part of the attaching part relative to the other part of the attaching part in the same direction as that of the bent part so that the protection wall part is parallel to the bent part, wherein the protection wall part has a protruding piece (35*b*) formed as the engaged part and protruding toward the opening.

[2] The connection terminal according to the configuration [1], wherein the protection wall part has a tip end which is located above a tip end of the bent part.

[3] The connection terminal according to the configuration [2], wherein the attaching part of the one terminal member includes two rotation-preventing parts (28) which are continuous so as to intersect with the attaching part and the bent part, and the rotation-preventing parts are provided at positions where the protection wall part is disposed between the rotation-preventing parts when the attaching parts are superposed one upon another.

The present invention is described above in detail by referring to the specific embodiment. It is to be understood, however, to a person with ordinary skill in the art that various changes or modifications may be added without deviating from the spirit and scope of the present invention.

This application is based on Japanese Patent Application No. 2012-231604 filed on Oct. 19, 2012, the contents of which are incorporated herein by reference.

INDUSTRIAL APPLICABILITY

According to the present invention, the engagement of the engaging part and the engaged part can be prevented from being insufficient or released. In addition thereto, the relative rotation of the two terminal members can be prevented. Thus, the connection terminal which can improve a positional shift preventing effect of the two terminal members can be realized. The present invention which achieves the above-described effects is available for the field of the connection terminal electrically connected to the electric wire.

REFERENCE SIGNS LIST

1: connection terminal
2, 3: terminal member (terminal fitting)
21, 31: wire connecting part
22, 32: attaching part
25*a*, 25*b*: engaging part
26: bent part
26*a*: opening
35*a*, 35*b*: engaged part
38: protection wall part

The invention claimed is:

1. A connection terminal comprising two terminal members which include hollow and tubular wire connecting parts to which conductors of electric wires are inserted and the conductors are electrically connected, and flat plate shaped attaching parts continuous to the wire connecting parts, wherein the two terminal members are configured such that the attaching parts are superposed one upon another in a state where an engaging part provided in the one terminal member is engaged with an engaged part provided in the other terminal member, the attaching part of the one terminal member has a bent part formed by bending a part of the attaching part relative to the other part of the attaching part, wherein the bent part has an opening formed as the engaging part, and the attaching part of the other terminal member has a protection wall part formed by bending a part of the attaching part relative to the other part of the attaching part in the same direction as that of the bent part so that the protection wall part is parallel to the bent part, wherein the protection wall part has a protruding piece formed as the engaged part and protruding toward the opening.

2. The connection terminal according to claim 1, wherein the protection wall part has a tip end which is located above a tip end of the bent part.

3. The connection terminal according to claim 2, wherein the attaching part of the one terminal member includes two rotation-preventing parts which are continuous so as to intersect with the attaching part and the bent part, and the rotation-preventing parts are provided at positions where the protection wall part is disposed between the rotation-preventing parts when the attaching parts are superposed one upon another.

* * * * *